United States Patent [19]

Dillon

[11] 4,163,410

[45] Aug. 7, 1979

[54] SHELL RELOADING MACHINE

[76] Inventor: Michael J. Dillon, 7021 E. Paradise Dr., Scottsdale, Ariz. 85254

[21] Appl. No.: 848,985

[22] Filed: Nov. 7, 1977

[51] Int. Cl.[2] ..... F42B 33/02

[52] U.S. Cl. ..... 86/23; 86/36

[58] Field of Search ..... 86/23, 24, 26, 27, 36, 86/37, 38

[56] References Cited

U.S. PATENT DOCUMENTS

| | | | |
|---|---|---|---|
| 2,031,850 | 2/1936 | Peterson | 86/23 |
| 3,110,214 | 11/1963 | Benda et al. | 86/36 |
| 3,483,792 | 12/1969 | Williams | 86/27 |
| 3,771,411 | 11/1973 | Hazel | 86/25 |
| 4,031,804 | 6/1977 | Boschi | 86/23 |

*Primary Examiner*—Harold Tudor

*Attorney, Agent, or Firm*—Warren F. B. Lindsley

[57] ABSTRACT

An improved shell reloading machine in which a swinging toggle linkage positioned below the tool head and shell carriage permits the incorporation of a swaging operation for the preparation of the primer cavity and the addition of an indexing mechanism for the automatic advance of the shell plate.

7 Claims, 15 Drawing Figures

SHELL RELOADING MACHINE

BACKGROUND OF THE INVENTION

For those who regularly practice firing rifles or pistols the cost of the ammunition is an expensive consideration. The professional law enforcement agent or the avid sportsman may fire a hundred rounds or more in a single practice session, and the cost in terms of the expended raw materials in addition to the monetary costs leads inevitably to the recognition that an appropriate salvage means is urgently needed for the recovery and re-use of the spent shells.

Shell reloading machines have been known for many years. U.S. Pat. No. 2,031,850, issued Feb. 25, 1936 to C. R. Peterson describes a progressive reloading machine which simultaneously performs the several functions required in the reloading process. Thus, the exploded primer cap is removed, a new primer is inserted, powder is delivered, the end of the shell is enlarged to receive the bullet and a bullet is positioned with each operation of the machine, the several operations taking place on a series of shells carried by the machine in a carriage which is manually rotated so as to move each of the several shells simultaneously carried thereby from one station to the next until the complete set of operations has been performed on each shell. A lever is operated to execute the various operations simultaneously on the several shells, so that while one shell is having its exploded primer cap removed, another is having a new primer inserted etc. Once an individual shell has completed the total circuit it is removed from the carriage and is replaced by another spent shell.

While the Peterson shell reloading machine has much utility, it has certain important limitations and shortcomings. First, the requirement for manually advancing the carriage after each operation is time-consuming and burdensome. Secondly, the machine does not incorporate a means for swaging the cap opening prior to the insertion of a new primer. This is a serious shortcoming, especially in the case of military cartridges in which the remaining crimped edge interferes with the proper seating of the replacement primer. Finally, the drive linkage coupled to the operating lever is not located in such a manner and is not sturdy enough to provide insufficient mechanical advantage to permit the incorporation of a swaging mechanism. It is also not capable of handling all caliber shells and their reloading capabilities.

These and other limitations of the presently-available reloading machines are eliminated in the reloading machine of the present invention.

SUMMARY OF THE INVENTION

In accordance with the invention claimed, an improved shell reloading machine is provided which incorporates all the essential functions for such a machine.

It is, therefore, one object of this invention to provide an improved machine for reloading shells.

Another object of this invention is to provide a machine which is capable of executing all of the essential operations involved in reloading including those performed by prior art machines such as removal of the exploded primer cap, resizing of the shell casing, insertion of a replacement primer, measurement and delivery of the powder charge, expanding and reshaping of the open end to receive the bullet, and positioning of the bullet.

A further object of this invention is to provide in such a machine a further capability for swaging the primer cap opening to remove the crimped edges prior to the seating of a replacement primer.

A still further object of this invention is to provide a relocated and improved drive linkage coupled to the operating lever, which has sufficient strength and mechanical advantage to permit the incorporation of the swaging operation.

A still further object of this invention is to provide an automatic mechanism for advancing the carriage with each operation of the lever.

A still further object of this invention is to provide the increased strength and mechanical advantage through the use of swinging toggle linkage coupled to the operating lever, the improved mechanical arrangement of the invention permitting the utilization of a linkage of this type while in prior art arrangements its application was not possible.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
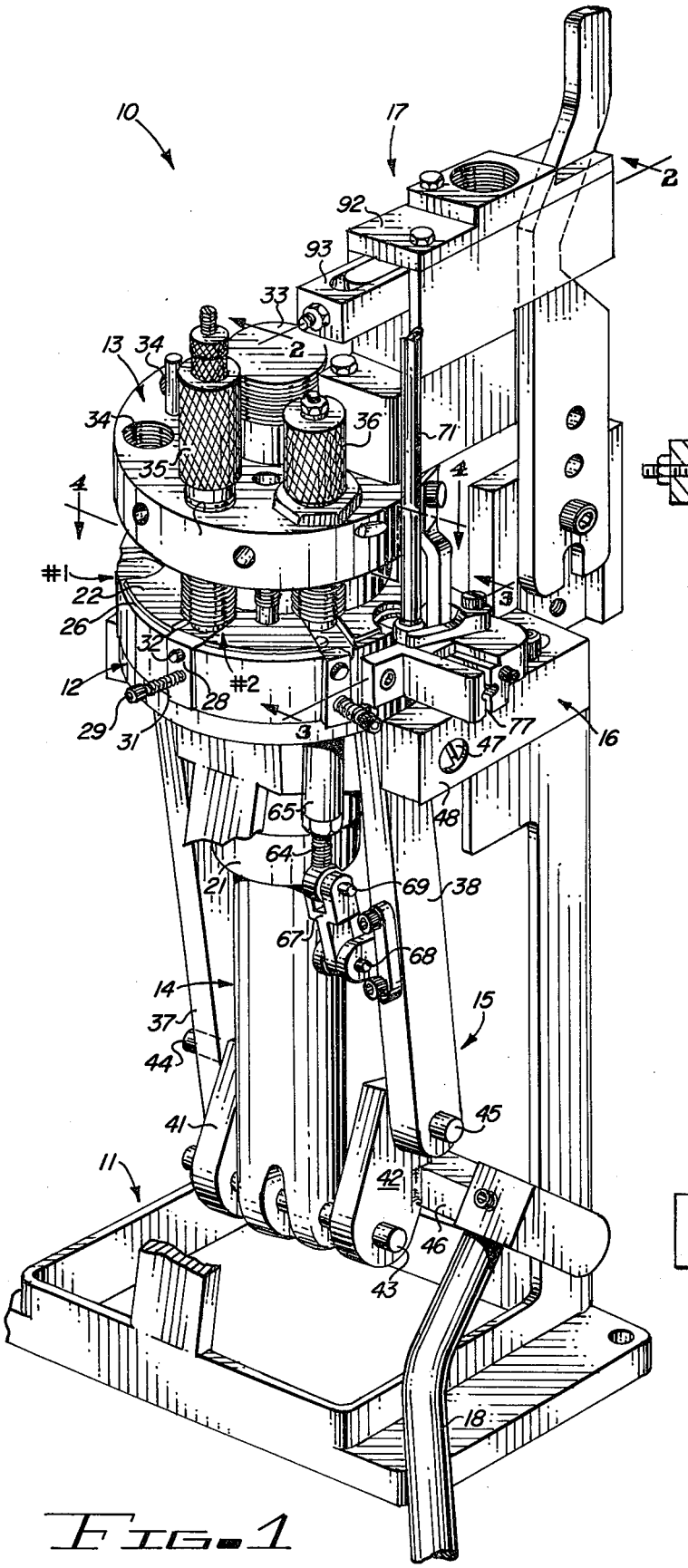
FIG. 1 is a perspective view of the shell reloading machine of the invention.
Figure 2:
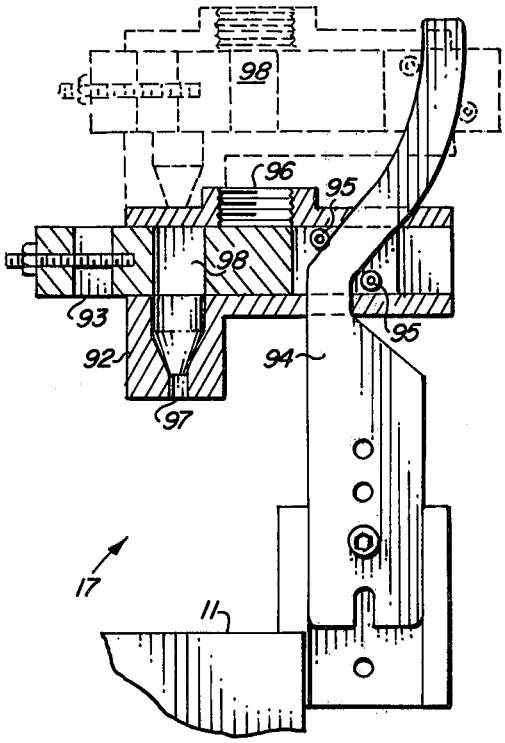
FIG. 2 is a cross-sectional side view of the powder dispensing portion of the machine of FIG. 1 as viewed along line 2—2 of FIG. 1.

Referring more particularly to the drawings by characters of reference, FIG. 1 discloses the improved shell reloading machine 10 of the invention including a supporting frame 11, a carriage support 12, a tool head 13 attached to the upper end of a drive shaft 14, a swinging toggle linkage 15, a primer feed mechanism 16 and a powder dispenser 17. The shaft 14 is driven vertically by means of an operating lever 18 acting through the linkage 15. Obscured from view in FIG. 1 is the carriage advance mechanism 19 as shown in FIGS. 10A–10D.

The frame 11 is of a sturdy construction and is cast in aluminum, steel or other high-strength material. Its base is formed to permit it to be secured by means of screws or bolts to a table or bench. The frame 11 fixedly supports the carriage support 12 and the powder dispenser 17.

The carriage support 12 is in the form of a heavy ring having a cross-section that is approximately an inverted T. The cylindrical center opening of the support 12 surrounds the shaft 14 serving as its guide member. Shaft 14 is precisely positioned horizontally by support 12 but moves freely vertically through the cylindrical opening provided by this member.

Figure 4:
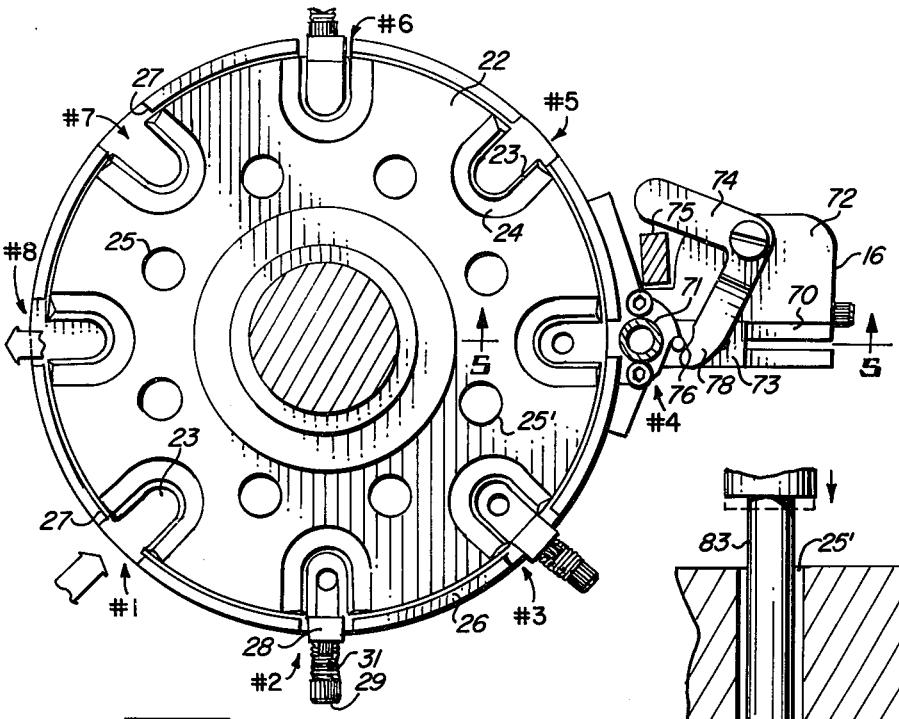
FIG. 4 is a cross-sectional top view of the shell carriage portion of the machine of FIG. 1 as viewed along line 4—4 of FIG. 1.

A shell positioning plate 22, as shown in FIGS. 1 and 4, rests in a centered annular depression on the top surface of support 12. Plate 22 is in the form of a flat disc having eight slots 23 equally spaced and opening outwardly about its outer periphery. Slots 23 are especially shaped and undercut to grip the flanged base of the shells which are to be reloaded. The opposite sides of each slot 23 are parallel and the inboard end of the slot is circular for conformance with the contour of the shell. A selection of plates 22 may be provided to fit a variety of shell sizes or removable inserts 24 may be employed to adapt plate 22 to different shell sizes.

Equally spaced about a circle inboard of the slots 23 are eight circular holes 25. The holes 25 are off-set relative to slots 23 such that each hole 25 lies along a radius which intersects the angular position of a pair of slots 23. Holes 25 are employed in connection with the indexing of plate 22 and also to provide clearance for a primer seating tool as will be discussed later.

The annular depression on the top surface of support 12 forms about its top periphery a wall 26 which blocks the ends of slots 23 of plate 22 except when plate 22 is indexed to align the eight slots 23 with the corresponding working stations. When plate 22 is in this position, the eight slots 23 are aligned with eight openings 27 in wall 26.

When plate 22 is aligned with one of the openings 27, an upright shell may be moved into position, its flanged base passing through opening 27 and beneath the edges of slot 23 as slot 23 provides clearance for the shell walls.

As shown in FIG. 4, each of the openings 27 in wall 26 defines an operating position, the eight positions being identified as positions #1 through #8. At position #1, the empty shell is inserted through opening 27 into slot 23. At the next operation of the operating lever 18, the shell is moved to position #2, then to position #3, etc., until it finally reaches position #8. When it reaches position #8, it has been subjected to all of the reloading operations and is automatically ejected through the open slot 23.

Adjustable locator straps 28 are provided as shown at positions #2, #3 and #6. The strap 28 is secured within a vertical slot in the side of support 12 by means of a screw 29 and a spring 31, spring 31 being confined between the head of screw 29 and the outer surface of strap 28. Screw 29 passes through a clearance hole in strap 28 to thread into a tapped hole in support 12. Spring 31 thus forces the strap against the base of the slot in which it is positioned. A set screw 32 threaded into the top end of strap 28 bears against the base of the slot and its adjustment controls the depth of penetration into the slot. The strap may be drawn back against the force of spring 31, withdrawn from the slot and rotated 90 degrees to clear opening 27 for the removal or replacement of a shell.

Shaft 14 has a threaded upper end 33. Tool head 13 has a tapped center opening which permits head 13 to be threaded over end 33 to the desired vertical and angular position where it is secured by a set screw.

Head 13 has eight threaded circular openings 34 equally spaced about its circular body, the openings 34 being spaced to permit alignment with the eight slots 23 of plate 22. The threaded openings 34 are intended to receive tools of different types. Thus, for example, at position #2, a shell sizing and primer removal tool 35 is installed, and at position #3 a swaging back-up tool 36 is provided. The vertical positions of such tools may, of course, be adjusted by turning to the desired depth within hole 34.

In the utilization of the tools carried by head 13, such as tools 35 and 36, head 13 is forced downward so that tools 35 and 36 envelop and press downwardly against some part or parts of the shell cases instantaneously positioned at the corresponding stations #2 and #3 within slots 23. Considerable downward force applied through shaft 14 is required to effect the simultaneous operations at the several stations. For this purpose, the special swinging toggle linkage 15 has been adapted to couple shaft 14 to operating lever 18.

Swinging toggle linkage 15 comprises two long lever arms 37 and 38, two short lever arms 41 and 42, a long pivot pin 43, two short pivot pins 44 and 45, and a cranking bar 46. The two long lever arms 37 and 38 are pivotally supported and suspended at opposite sides of shaft 14. For this purpose, a pivotal mounting screw 47 passes through a frame member 48, as shown in FIG. 1, and through a hole in the upper end of lever 38. Lever 37 is similarly supported at the opposite side, the two lever arms 37 and 38 being oriented to swing in parallel planes. The lower ends of lever arms 37 and 38 are pivotally coupled to the upper ends of short lever arms 41 and 42, respectively, by means of pivot pins 44 and 45, arms 41 and 42 again oriented to swing in parallel planes with arms 37 and 38. The long pivot pin 43 passes through holes in the lower ends of arms 41 and 42 and through a hole in the lower end of shaft 14, the lever arms 37, 38, 41 and 42 serving as a kind of sling which supports shaft 14 and tool head 13 secured to its upper end. Cranking bar 46 is oriented horizontally and is laterally attached to the rear edges of lever arms 41 and 42 by welding or other rigid attachment means.

Figure 11A:
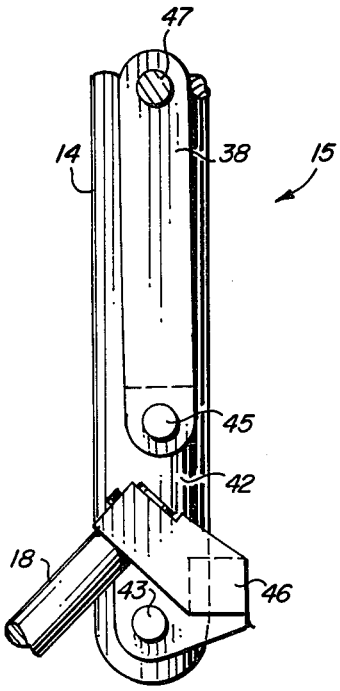
FIGS. 11A and 11B are side views of the drive linkage of the machine of FIG. 1 shown for two positions of the operating lever.
Figure 11B:
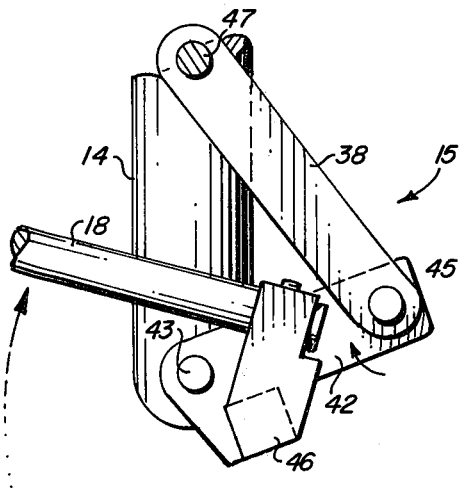

The operating lever 18 is rigidly attached perpendicularly to one end of rocker arm 46 so that as lever 18 is moved up and down, it causes lever arms 41 and 42 to pivot about pin 43 as shown in FIGS. 11A and 11B. In FIG. 11A with lever 18 fully downward, the lever arms 37 and 38 are linearly aligned with the lever arms 41 and 42, respectively, and shaft 14 is at its lowest position. In FIG. 11B, lever 18 has been raised so that lever arms 41 and 42 have rotated to a nearly horizontal position causing shaft 14 to move upward. It will be appreciated that in the downward stroke the mechanical advantage of the swinging toggle linkage 15 is greatest because at this point a given angular rotation produces the smallest increment of downward travel for the shaft 14. This is also the point in the operation of the tools mounted to head 13 requiring the greatest amount of force, so that the mechanical advantage afforded by linkage 15 is ideally applied in this manner. A further advantage of this specific arrangement is that a part of the downward force applied to lever 18 is transferred directly to shaft 14 to augment the downward movement coupled through lever arms 37, 38, 41 and 42.

Figure 10C:
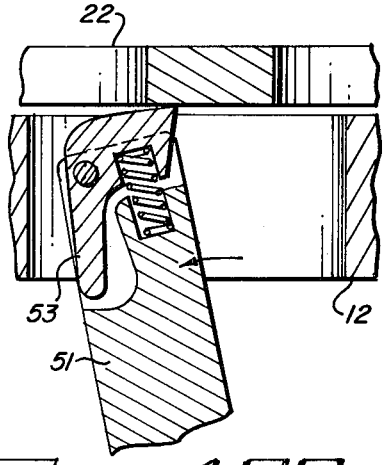
FIGS. 10A, 10B, 10C and 10D are cross-sectional side views of the carriage indexing mechanism of the machine of FIG. 1.
Figure 10D:
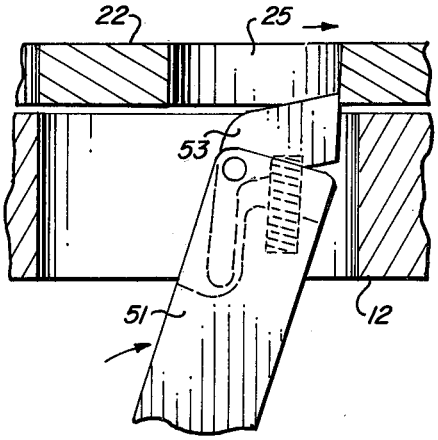
Figure 10A:
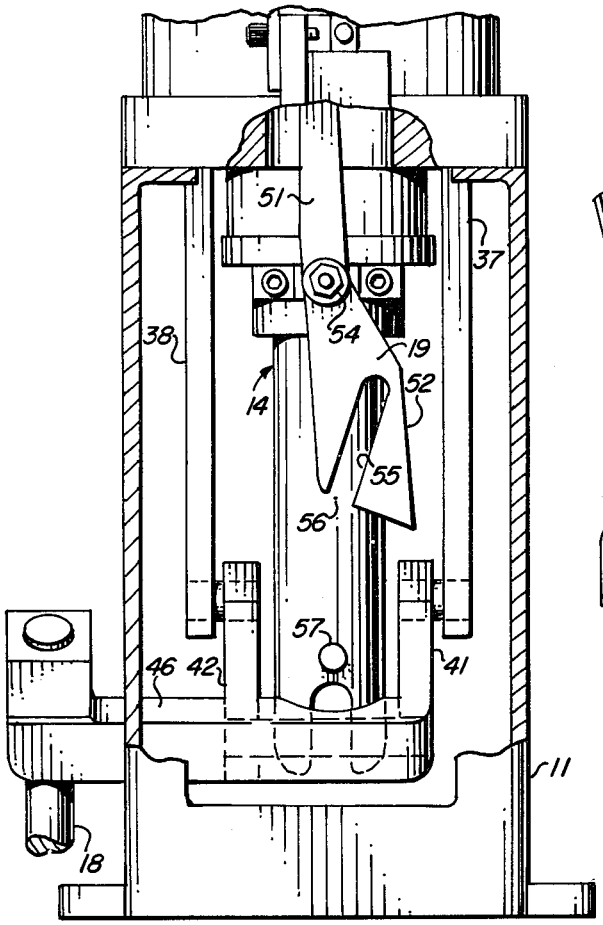
Figure 10B:
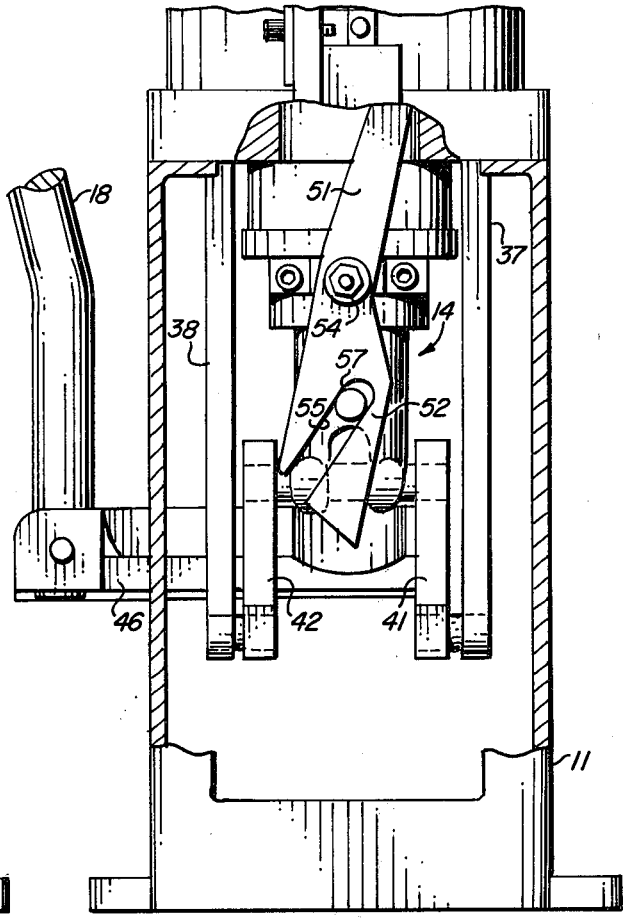

The carriage indexing mechanism shown in FIGS. 10A–10D comprises an indexing arm 51 with an angularly slotted lower end 52 and a spring-loaded pawl 53 at the upper end. Arm 51 has its upper end captured within a slot in support 12 which extends to the underside of positioning plate 22. At a point near the lower end of arm 51 just above slotted end 52 a pivot pin 54 secures arm 51 to the rear side of support 12. Arm 51 is balanced so that its top end as shown in FIGS. 10A–10C falls leftward to a rest position in the absence of externally applied forces. In the rest position the pawl 53 engages one of the holes 25. Also with arm 51 in the rest position the angular slot 55 opens downward at a point 56 aligned with the center of shaft 14. From point 56 slot 55 is inclined upward and toward the right. Extending perpendicularly from the side of shaft 14 at a point directly below point 56 is a pin 57. Now as shaft 14 rises under the action of lever 18 and linkage 15, pin 57 moves upward, engages the open end of slot 55, then continuing upward forces the lower end 52 of arm 51 leftward causing arm 51 to pivot clockwise about pin 54 and thereby moving the top end of arm 51 to the right. The pawl 53 engaged with one of the holes 25 moves plate 22 with it causing plate 22 to be advanced one position. As the shaft 14 is then lowered the top end of arm 51 moves toward the left and pawl 53 is disengaged. The rough positioning accomplished in this manner is refined by means of a conventional spring loaded ball and socket arrangement further supplemented by a tapered pin which passes through a hole in plate 22 near the beginning of the downward stroke of lever 18 to effect the precise positioning required for tool operation.

Remaining to be described are the various tools and mechanisms which are operative at the several shell positions. These will now be described along with a discussion of the progressive operations effected in the reloading of an individual shell.

The fired shell case is inserted at position #1 as shown in FIGS. 1 and 4. It will be noted that hole 34 in head 13 directly above position #1 is vacant and there is no positioning plate 28 present at position #1 to interfere with the insertion of a shell.

Figure 6:
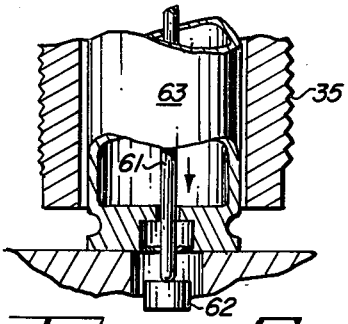
FIG. 6 is a cross-sectional view of a shell having its primer removed by the machine of FIG. 1.

With the next elevation of lever 18 the shell entered at position #1 is advanced by indexing arm 51 to position #2. Then with the lowering of lever 18 a sizing die contained in tool 35 is forced down over the shell to reshape its walls while a pin 61 shown in FIG. 6 dislodges the spent primer 62 from the base of shell 63.

Figure 7:
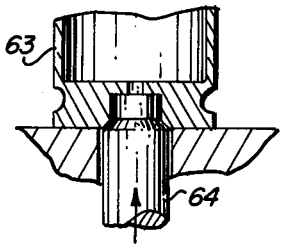
FIG. 7 is a cross-sectional view of a shell having its primer pocket swaged by the machine of FIG. 1.
Figure 8:
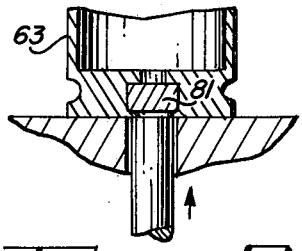
FIG. 8 is a cross-sectional view of a shell having a new primer seated by the machine of FIG. 1.

The raising of lever 18 then withdraws tool 35 upward and advances shell 63 to position #3 which lies directly below swaging back-up tool 36. Working in conjunction with tool 36 is the swaging ram 64 which is driven upward through a cylinder 65 mounted to the underside of support 12 directly below position #3 and tool 36. Ram 64 is coupled to lever 38 of linkage 15 by means of a bracket 66 and pivoting linkage arm 67. Arm 67 is pivotally coupled at one end to bracket 66 by a pin 68 and is pivotally coupled at its other end to the lower end of ram 64 by a pin 69. As arm 38 moves forward with the lowering of lever 18, the ram 64 is driven upward, its upper end being forced into the primer cavity of shell 63 at the end of the stroke as shown in FIG. 7 to remove the crimped edges from the cavity in preparation for the replacement of the primer. The backup tool 36 holds the shell in position as the swaging takes place.

Figure 3:
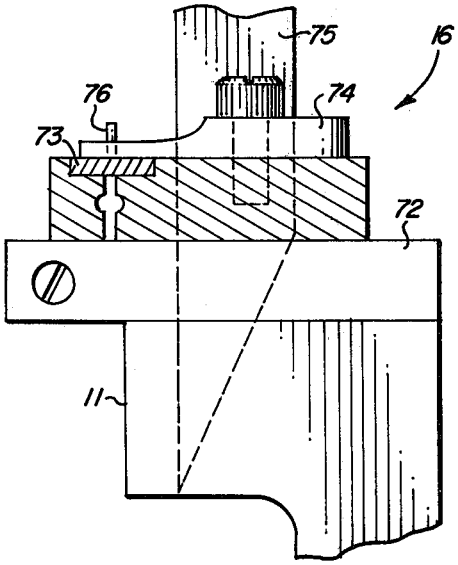
FIG. 3 is a cross-sectional side view of the primer feeding portion of the machine of FIG. 1 as viewed along line 3—3 of FIG. 1.

As lever 18 is again raised the swaging ram is forcefully withdrawn then the shell 63 is advanced to position #4 at which position a new primer is to be seated. The primer feed mechanism 16 located at position #4 is similar to prior art mechanisms. As shown in FIGS. 1, 3 and 4, mechanism 16 comprises a vertical primer feed tube 71, a carriage support 72, a spring-loaded slide 73, a lever 74, and a cam 75. Carriage support 72 is mounted to frame 11 at a point just outboard of position #4 and in turn it supports tube 71 just outside the openings 27 in wall 26. A depression 70 in the top surface of support 72 extends radially outward from opening 27 and carries the flat rectangular slide 73. Slide 73 has a centered perpendicularly projecting pin 76 located near its outboard end which extends downward into a centered vertical slot 77 in the base of the depression in support 72 and extends upward for engagement with lever 74. Lever 74 is "L"-shaped and is pivotally attached at its center to the top surface of support 72 at one side of depression 70. One leg 78 of lever 74 engages pin 76 of slide 73 while the other leg 79 engages cam 75. Cam 75 is a flat vertical strap with a tapered lower end. It is secured at its upper end to the side of tool head 13 so that its tapered lower end moves past the edge of arm 79. As cam 75 moves upward with head 13 the tapered lower end of cam 75 permits lever 74 to rotate clockwise as driven by the spring-loaded slide 73 as slide 73 is engaged by means of pin 76. In the fully withdrawn position of slide 73 a primer 81 from tube 71 falls into an aligned hole in slide 73. As head 13 and cam 75 are subsequently lowered, cam 75 drives lever 74 clockwise as viewed from above, lever 74 in turn drives slide 73 inward carrying with it the primer 81 to a point directly below the shell 63.

Figure 5:
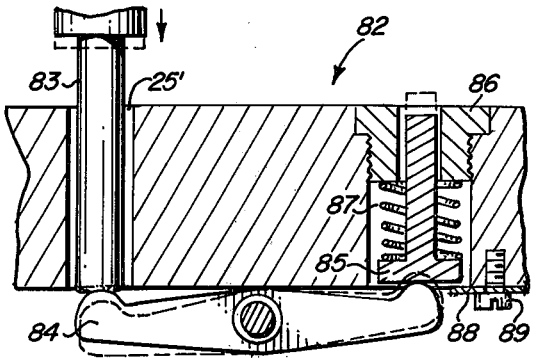
FIG. 5 is a cross-sectional side view of the primer seating mechanism of the machine of FIG. 1 as viewed along line 5—5 of FIG. 4.

As the downward stroke of lever 18 continues, the primer seating mechanism 82 of FIG. 5 comes into play. Mechanism 82 comprises a ram 83, a rocker arm 84 a capped pin 85, a retainer ring 86, a spring 87 and a retaining washer 88. Retainer ring 86 is threaded into the top of a hole in support 12 located directly under position #4. Pin 85 extends upward through spring 87 and the opening in ring 86, and is held in place against the action of spring 87 by washer 88 and a screw 89. Ram 83 extends from the lower surface of tool head 13 in alignment with hole 25' of FIG. 4. Pivotally mounted just below a line joining the center of hole 25' and pin 85 is the rocker arm 84 as shown in FIG. 5. As the tool head 13 approaches the lower extremity of its travel the base of ram 83 strikes the left-hand end of rocker arm 84 driving it downward and causing arm 84 to pivot about its axis 91 so that its right-hand end moves upward driving pin 85 upward. The upper end of pin 85 drives the primer carried by slide 73 into the primer cavity of shell 63.

Figure 9:
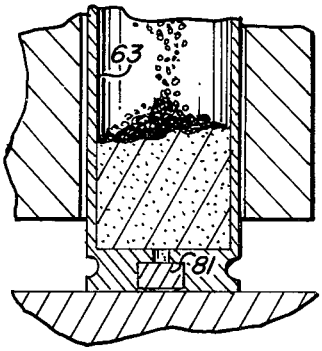
FIG. 9 is a cross-sectional view of a shell being refilled with powder by the machine of FIG. 1.

As lever 18 is raised again shell 63 is advanced to position #5 where it receives its charge of powder from dispenser 17. Powder dispenser 17 comprises a housing 92 secured to tool head 13, a sliding carriage 93 operating within a longitudinal opening in housing 93, and a cam 94 which is secured at its base to frame 11. The upper end of cam 94 sweeps upward and to the right through a slot in housing 92 and between two drive pins 95 attached to carriage 93. At the top center of housing 92 is an opening 96 which receives a supply of powder from a hopper not shown in the drawing. Leftward of opening 96 on the underside of housing 92 is a spout 97 extending downward for the delivery of powder to the shell cases. As the housing 92 is moved vertically by the action of the tool head 13 the drive pins 95 follow the sweep of cam 94 causing the carriage 93 to move horizontally within the longitudinal opening in housing 92. In the raised position of head 13 the carriage is positioned to the right such that a cavity 98 which extends vertically through carriage 93 is aligned with the opening 96 of housing 92. Powder thus flows through opening 96 to fill the cavity 98. As head 13 and housing 92 subsequently move downward, the carriage 93 moves to the left until the cavity 98 is aligned with the flared top of spout 97 whereupon the powder charge of cavity 98 flows downward through spout 97 into the open top end of shell 63 as shown in FIG. 9.

As the lever 18 is raised again the carriage 93 returns to the right, cavity 98 is again filled with a charge of powder for the next shell, and shell 63 is advanced to position #6 where the subsequent stroke of lever 18 causes a bullet to be seated. The shell is then advanced by two subsequent strokes to position #8 from which it is discharged into a collection bin.

A complete and effective shell reloading machine is thus provided in accordance with the stated objects of the invention. The several operations are accomplished automatically with manual intervention required only for the insertion of the shells at position #1 and for the operation of the lever 18. In addition to those operations afforded by prior art machines, the reloading machine of the invention swages the primer opening and advances the shell automatically from one position to the next. The provision of the swaging operation enables the reloading of certain military shells that cannot be reloaded by prior art machines and the automatic shell advance greatly speeds the operation. The novel application of the swinging toggle linkage provides the increased mechanical advantage required by the swaging operation and reduces the required operator effort.

Although but a single embodiment of the invention has been illustrated and described it will be apparent to those skilled in the art that various changes and modifications may be made therein without departing from the spirit of the invention or from the scope of the appended claims.

What is claimed is:

1. A shell reloading machine comprising in combination:

a table, a shell registering plate revolubly mounted thereon and adapted to carry a plurality of shells, a support mounted above said table and plate, a plurality of tools mounted on said support one at each of a plurality of work stations for preparing and reloading shells depending from said plate and arranged in a circle so as to register with a plurality of shells held by said plate, said tools sequentially comprising at each of said work stations a sizing die for reshaping the shells' outer walls and dislodging the spent primer from a primer cavity in the shell, a swaging tool assembly, primer insertion tool for inserting a new primer in the primer cavity of the shell, a powder dispenser and a bullet positioner and securing element, lever means for rotating said plate to sequentially cause registration of each of the shells held by said plate with each of said tools at each of said work stations, said lever means being mounted below said plate and comprising indexing means for engaging said plate for sequentially moving said plate from registration with one tool to registration at the next position with another tool with each predetermined movement of said lever means, means coupled to said lever arm for simultaneously moving each of said tools into registry with a shell held by said plate at each work station during predetermined movement of said lever arm, said swaging tool assembly enveloping and pressing downwardly against the associated shell when moved into registry therewith, and a ram coupled to and actuated by said lever arm for moving into the primer cavity of the shell enveloped by said swaging tool assembly in a direction opposite to the movement of said swaging tool assembly for removing any of its crimped edges.

2. The shell reloading machine set forth in claim 1 wherein:

said swaging tool assembly when enveloping an associated shell providing circumferential support for the shell during the swaging operation.

3. The shell reloading machine set forth in claim 1 wherein:

said means coupled to said lever arm for simultaneously moving each of the tools into registry with a shell comprises a swinging toggle linkage.

4. The shell reloading machine set forth in claim 1 wherein:

said lever means is moved in one direction to advance a given shell on said plate to the next tool, and moved in a second direction to actuate said means to move each of said tools at their respective work stations into registry with the associated shell.

5. The shell reloading machine set forth in claim 1 wherein:

said plate is provided with a plurality of open ended slots spacedly positioned around the periphery of said plate for receiving and holding the shell while in the machine.

6. The shell reloading machine set forth in claim 1 wherein:

said plate is provided with a plurality of apertures equally spaced in a circle around said plate, and said indexing means comprises a pawl mounted on said lever means for moving sequentially into each of said apertures for aligning said tools at said work stations with the associated shell on said plate.

7. The shell reloading machine set forth in claim 6 wherein:

said apertures in said plate are spaced inwardly of the periphery of said plate and said slots.

* * * * *